United States Patent [19]

Backer et al.

[11] Patent Number: 4,467,935

[45] Date of Patent: Aug. 28, 1984

[54] RANDOM COIL ULTRASONIC SEAL

[75] Inventors: Simon Backer, Toronto; Michael T. Smith, Pembroke, both of Canada

[73] Assignee: Atomic Energy of Canada Limited, Ottawa, Canada

[21] Appl. No.: 544,380

[22] Filed: Oct. 21, 1983

[30] Foreign Application Priority Data

Oct. 25, 1982 [CA] Canada ..... 414113

[51] Int. Cl.[3] ..... B65D 53/00; B65D 55/02

[52] U.S. Cl. ..... 220/214; 220/265; 220/288

[58] Field of Search ..... 220/214, 288, 265

[56] References Cited

U.S. PATENT DOCUMENTS 2,838,200 6/1958 Brewer ..... 220/214

4,140,148 2/1979 Richter ..... 220/214

*Primary Examiner*—George T. Hall

*Attorney, Agent, or Firm*—Edward Rymek

[57] ABSTRACT

The seal consists of a hollow stud member which is welded to the enclosure to be secured and a cap member which holds the enclosure cover in place when secured to the stud. The cap member has a body section and a pin element extending from it. The pin element has an end portion that is shaped so as to be permanently secured once it enters a receiving element in the stud member. The cap member further has a random identity element, such as a randomly wound coil mounted in a cavity within the cap body. One end of the identity element is fixed to the cap member body section and the other end is fixed to the pin element end portion; such that the identity of the identity element is altered when the end portion is broken away from the pin element.

6 Claims, 2 Drawing Figures

RANDOM COIL ULTRASONIC SEAL

BACKGROUND OF THE INVENTION

This invention is directed to a seal for assuring that a container is tamper-resistant and, in particular, to a seal which can be scanned ultrasonically to determine its integrity and its identity.

Over the years it has been desirable for many reasons to assure that containers are tamper-resistant, whether they be letters, parcels, boxes, and all sorts of other enclosures such as trucks, trailors, boxcars and the like. The most commonly used seal is the wire or customs type seal in which a wire or cable is joined such as by twisting or crimping in a tamper resistant closure. This type of seal, which would have an identification number printed or stamped on it, can easily be replaced and therefore the enclosure must be inspected to be sure that it has not been entered.

This general lack of security is not satisfactory, particularly in applications such as the storage of spent fuel in nuclear establishment. Seals used in these applications must be under water and, therefore, it is desirable to be able to inspect the integrity of the seal and, thus, indirectly the enclosure, both remotely and without removal of the seal. Once the integrity of the seal is determined, the inspection must also reveal the unique identity of the seal.

It has been found that ultrasonic methods lend themselves to the inspection of seals under conditions in which direct inspection is not possible. One such method is described in British Pat. No. 1,278,749 which issued to the European Atomic Energy Community. In accordance with this patent, the identity of the seal is incorporated into the seal by a random distribution of material in the seal body which provides a unique signature when scanned by an ultrasonic reader. Thus, it may be determined whether the seal has been changed, however, if the seal is broken and repaired, the identity of the seal is not altered. Only the identity of the seal can be initially determined and its integrity requires a separate check.

SUMMARY OF THE INVENTION

It is therefore an object of this invention to provide a seal in which both the integrity and the identity may be determined by a remote inspection.

This and other objects are achieved in a seal comprising a hollow stud member having pin receiving means within the stud member, and a cap member having a body section and a pin element extending therefrom. The pin element has an end portion that is shaped such that it will enter the stud member pin receiving means and once in, it will be permanently secured therein. The cap member further has a random identity element fixed to the cap pin element end portion and the cap member body section such that the identity of the identity element will be altered when the end portion is broken away from the pin element.

In accordance with one embodiment of the invention, the identity element is a randomly wound coil mounted in a cavity within the cap body. One end of the coil is fixed to the cap body and the other end of the coil is fixed to the end portion of the pin that is broken away when the cap is removed.

Many other objects and aspects of the invention will be clear from the detailed description of the drawings.

DETAILED DESCRIPTION

Figure 2:
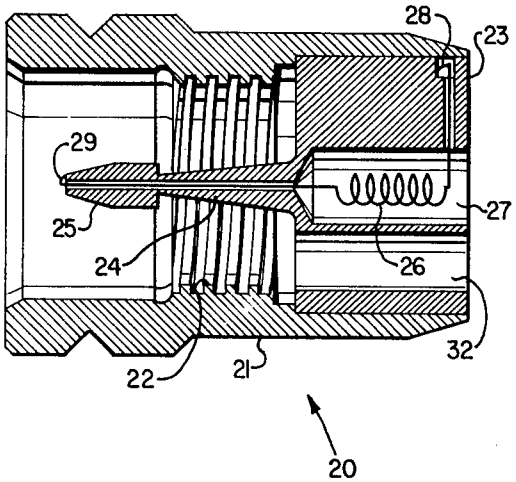
FIG. 2 illustrates the cap of a seal in accordance with the present invention.
Figure 1:
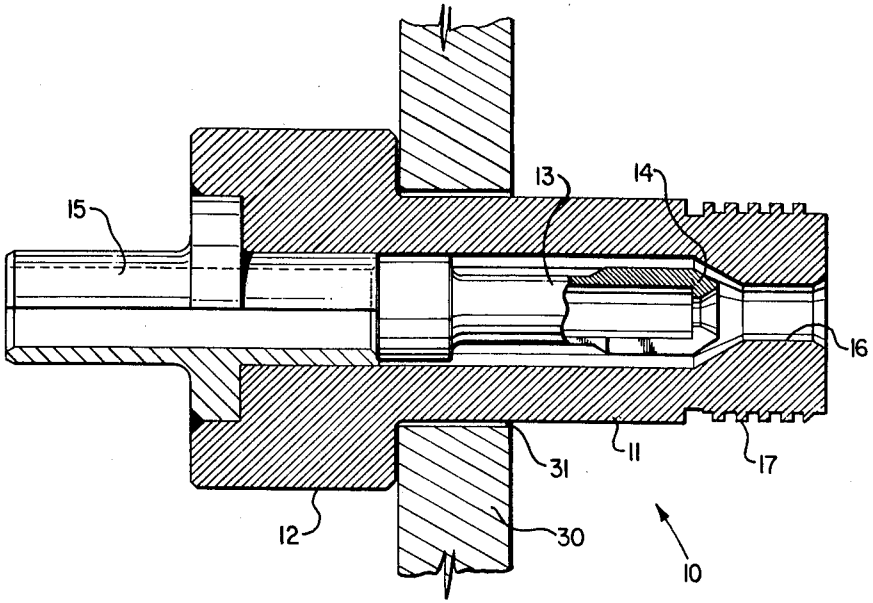
FIG. 1 illustrates the stud of a seal in accordance with the present invention.

The seal will be described in conjunction with FIG. 1 and 2 which illustrate, respectively, a stud member 10 for the seal and a cap member 20 for the seal. The stud member consists of a cylinder 11 which is enlarged at one end 12. This enlarged end provides sufficient mass and surface to weld the stud 10 to the top of an enclosure (not shown) to be secured. With one or more studs welded or otherwise fixed to the inside surface of the enclosure, a cover 30, with appropriate holes 31 therein to receive the studs 10, will cover the enclosure.

The stud member 10 also includes a cylindrical receiving element 13 loosely mounted within cylinder 11. Element 13 includes a split collet 14 to permanently secure the seal cap 20 to it as will be described below. A hollow plug 15 is welded into the enlarged end 12 of cylinder 11. Its length is such that when in place, the receiving element may move at least a short distance along the length of the cylinder. The inside surface 16 of the upper end of the cylinder 11 is tapered inward to prevent the receiving element 13 from being pulled out of the cylinder 11. The outside surface 17 of cylinder 11 may be threaded as a means of fixing it to cap 20.

Cap 20 consists of a hollow cylindrical housing 21 which also may have a threaded inner surface portion 22 to match the threaded end 17 of stud 10. When the cap is screwed or placed onto the stud 10, cover 30 can no longer be removed. The cap 20 also includes a body section 23 fixed within the housing 21. Body section 23 is preferably welded into the cap housing 21 or so fixed. The cap body 23 and the cap housing 21 are designed so that once installed on stud 10 the housing 21 cannot be removed while the body 23 remains attached to the stud 10. One or more holes 32 may be located in body section 23 to facilitate the positioning of an ultrasonic scan device with respect to the seal. The body section 23 further includes an elongated pin 24 integral with the body 23 and extending downward from it through the interior of housing 21. The end 25 of pin 24 is shaped such that it will enter receiving element 13 but that it will be permanently secured within it by collet 14.

In this particular embodiment, pin 24 is tapered to a narrow neck area with the enlarged end being somewhat in the shape of a frustum. This will assure that once the end 25 is locked in the receiving element 13, by the collet 14, it will not come out, and end 25 will break away from pin 24 if an attempt is made to remove the cap 20 from the stud 10.

In order to facilitate the entry of the end 25 of pin 24 past the collet 14, collet 14 is split such that it will bend away from the center as end 25 enters the receiving element 13. In this situation, it is preferable that receiving element 13 move freely with cylinder 11 and that the neck portion 16 be tapered such that the collet 14 will wedge itself into the narrowed inner surface 16 preventing it from opening when an attempt is made to remove pin 24.

The stud 10 and cap 20 may be made from any of a number of materials depending on the use of the seal.

For nuclear applications, all components of the seal are preferably made from stainless steel.

An identity element 26 is mounted within the body 23 and pin 25 of the cap 20. In this embodiment, the identity element 26 consists of a randomly wound coil 26 positioned in a cavity 27 within the body 23 having one end 28 fixed to the body 23 and the other end 29 passing through an opening within the pin 24 and fixed to the enlarged end 25. Since the coil 26 is random in shape, i.e. varying in pitch and diameter, and even in size of wire, the ultrasonic scan of the identity element will provide a unique identity signature which may be recorded once the seal is in place. If the cap 20 is removed for any reason, end 25 will break within receiving element 13, affecting the shape of coil 26. Thus, the identity of the coil which cannot be duplicated, will be changed indicating that the integrity of the seal has been tampered with. The enclosure would then have to be thoroughly inspected.

To resecure the enclosure, the seal in its entirety need not be replaced. The broken end 25 will fall through the receiving element 13 and the hollow plug 15, and thus the stud 10 need not be replaced. A new cap 20 will be used to secure the enclosure, or at least a new cap body 23 with pin 24 identity element 26 will be necessary to refit the cap housing 21.

Though a coil that has a circular cross-section is shown as being used for the identity element 26, coils with other cross-sections such as square, oblong, triangular or hexagonal alternately may be used. In addition, the identity element need not be a coil, but may take another form, such as a helix, as long as the element can be formed randomly in order to produce individual identity signatures under ultrasonic scan, and as long as it can be mounted in the cap 20 such that the breaking of end 25 alters the shape of element 26.

Many modifications in the above described embodiments of the invention can be carried out without departing from the scope thereof and, therefore, the scope of the present invention is intended to be limited only by the appended claims.

We claim:

1. A seal comprising:

- a hollow stud member having pin receiving means within the stud member;
- a cap member having a body section and a pin element extending therefrom, the pin element having an end portion shaped for entering the stud member receiving means to be permanently secured therein, the cap member further having a random identity element fixed to the pin element end portion and the cap member body section such that the identity of the identity element is altered when the end portion is broken away from the pin element.

2. A seal as claimed in claim 1 wherein the identity element is a randomly wound coil mounted within a cavity in the cap body and with one end fixed to the cap body and the other end fixed to the pin element end portion.

3. A seal as claimed in claim 1 wherein the cap member further includes a housing for the cap body section.

4. A seal as claimed in claim 2 wherein the cap member further includes a housing the for cap body section.

5. A seal as claimed in claim 3 wherein the cap housing and the stud member are threaded for coupling the cap member to the stud member.

6. A seal as claimed in claim 4 wherein the cap housing and the stud member are threaded for coupling the cap member to the stud member.

* * * * *